US007535332B2

(12) United States Patent
Furuuchi et al.

(10) Patent No.: US 7,535,332 B2
(45) Date of Patent: May 19, 2009

(54) PROTECTIVE ELEMENT

(75) Inventors: Yuji Furuuchi, Tochigi (JP); Hisaya Tamura, Tochigi (JP); Masahiro Matsuyoshi, Tochigi (JP); Kazutaka Furuta, Tochigi (JP); Masami Kawazu, Tochigi (JP)

(73) Assignee: Sony Chemicals Corporation, Tokyo (JP)

( * ) Notice: Subject to any disclaimer, the term of this patent is extended or adjusted under 35 U.S.C. 154(b) by 191 days.

(21) Appl. No.: 10/538,754

(22) PCT Filed: Dec. 5, 2003

(86) PCT No.: PCT/JP03/15603

§ 371 (c)(1),
(2), (4) Date: Jun. 10, 2005

(87) PCT Pub. No.: WO2004/061885

PCT Pub. Date: Jul. 22, 2004

(65) Prior Publication Data

US 2006/0125594 A1 Jun. 15, 2006

(30) Foreign Application Priority Data

Dec. 27, 2002 (JP) ..... 2002-382566

(51) Int. Cl.
*H01H 85/08* (2006.01)
*H01H 85/044* (2006.01)

(52) U.S. Cl. ..... 337/182; 337/183; 337/159

(58) Field of Classification Search ..... 337/182–185, 337/4, 159
See application file for complete search history.

(56) References Cited

U.S. PATENT DOCUMENTS 3,839,692 A * 10/1974 Plasko ..... 337/182
4,041,435 A 8/1977 Gaia
4,101,860 A 7/1978 Fister
4,124,835 A * 11/1978 Cahill, Jr. ..... 337/1
RE30,158 E * 11/1979 Bucklin et al. ..... 337/166

(Continued)

FOREIGN PATENT DOCUMENTS

DE 25438891 A1 4/1976

(Continued)

*Primary Examiner*—Anatoly Vortman
(74) *Attorney, Agent, or Firm*—Oliff & Berridge, PLC

(57) ABSTRACT

A protective element has a heat-generating member and a low-melting metal member on a substrate, in which the low-melting metal member is blown out by the heat generated by the heat-generating member, wherein at least two strips of low-melting metal member are provided as the low-melting metal member, for example, between the pair of electrodes that pass current to the low-melting metal member, so that the lateral cross section of at least part of the low-melting metal member is substantially divided into at least two independent cross sections. This protective element has a shorter and more consistent operating time. It is preferable here to provide at least two strips of low-melting metal member between the pair of electrodes that pass current to the low-melting metal member. It is also preferable to provide one strip of low-melting metal member having a slit in its center, between the pair of electrodes that pass current to the low-melting metal member.

1 Claim, 7 Drawing Sheets

(y—y cross section )

U.S. PATENT DOCUMENTS

| | | | | |
|---|---|---|---|---|
| 5,084,691 | A * | 1/1992 | Lester et al. | 337/297 |
| 5,621,602 | A * | 4/1997 | Winkelmann | 361/104 |
| 5,652,562 | A * | 7/1997 | Riley | 337/405 |
| 5,712,610 | A * | 1/1998 | Takeichi et al. | 337/290 |
| 5,793,274 | A * | 8/1998 | Kelly et al. | 337/183 |
| 5,907,272 | A * | 5/1999 | McGuire | 338/22 R |
| 6,269,745 | B1 * | 8/2001 | Cieplik et al. | 102/202.5 |
| 6,300,859 | B1 * | 10/2001 | Myong et al. | 337/182 |
| 6,344,633 | B1 | 2/2002 | Furuuchi | |
| 6,452,475 | B1 | 9/2002 | Kawazu et al. | |
| 6,489,879 | B1 * | 12/2002 | Singh et al. | 337/167 |
| 7,265,653 | B2 * | 9/2007 | Rupalla et al. | 337/185 |
| 2001/0044168 | A1 | 11/2001 | Furuuchi et al. | |
| 2004/0100355 | A1 * | 5/2004 | Tanaka | 337/404 |

FOREIGN PATENT DOCUMENTS

| | | | |
|---|---|---|---|
| DE | 2723487 | A1 | 12/1977 |
| EP | 1 041 597 | A2 | 10/2000 |
| EP | 1 045 418 | A2 | 10/2000 |
| JP | A 52-31363 | | 3/1977 |
| JP | A 53-8755 | | 1/1978 |
| JP | U 62-107335 | | 7/1987 |
| JP | A 8-161990 | | 6/1996 |
| JP | A 10-116549 | | 5/1998 |
| JP | B2 2790433 | | 6/1998 |
| JP | A 11-7876 | | 1/1999 |
| JP | A 11-120890 | | 4/1999 |
| JP | A 2000-285778 | | 10/2000 |
| JP | A 2000-306477 | | 11/2000 |
| JP | A 2001-325868 | | 11/2001 |
| JP | A 2001-325869 | | 11/2001 |

* cited by examiner (x − x cross section)

( x − x cross section )

( x − x cross section )

( x — x cross section )

(y—y cross section )

(x − x cross section)

(x − x cross section)

PROTECTIVE ELEMENT

TECHNICAL FIELD

This invention relates to a protective element in which a heat-generating member generates heat that blows out a low-melting metal member in the event of a malfunction.

BACKGROUND ART

Protective elements in which a heat-generating member and a low-melting metal member are layered or disposed in the same plane on a substrate are known as protective elements that can be used to prevent not only over-current but also overvoltage, and which are useful in secondary cells for portable electronic devices and so forth (Japanese Patent No. 2,790,433, Japanese Patent Application Laid-Open No. H10-116549). With this type of protective elements, in the event of a malfunction, current flows to the heat-generating member, and the heat-generating member generates heat, which blows out the low-melting metal member.

The increasing performance of portable electronic devices in recent years has required the above protective elements to have higher rated current. One way to raise the rated current of a protective element is to increase the thickness or width of the low-melting metal member and thereby increase its cross sectional area and lower its resistance. Unfortunately, the problem with increasing the cross sectional area of the low-melting metal member is that it results in a longer operating time needed to block off current in the event of overcurrent or overvoltage. Moreover, increasing the thickness of the low-melting metal member goes against the need to make elements thinner.

Yet another problem with the above-mentioned protective elements was the variance in the time it took for the low-melting metal member to go from a molten state to being blown out by the heat generated by the heat-generating member, and it has been proposed to set a specific relationship between the low-melting metal member and the blow-out effective electrode surface area (Japanese Patent Application Laid-Open No. 2001-325869).

It is an object of the present invention to provide a protective element comprising a heat-generating member and a low-melting metal member on a substrate, in which the low-melting metal member is blown out by the heat generated by the heat-generating member, wherein the operating time is shortened even when the sectional area of the low-melting metal member has been increased in order to raise the rated current, and the time from heat generation of the heat-generating member up to blow-out is more consistent.

DISCLOSURE OF THE INVENTION

The inventors discovered that if the lateral cross section of the low-melting metal member between the pair of electrodes that pass current to the low-melting metal member is divided into two or more independent cross sections by providing at least two strips of the low-melting metal member between these electrodes, for example, there will be more points where blow-out begins in the low-melting metal member, the operating time will be shorter, and the operating time will be more consistent.

Specifically, the present invention provides a protective element comprising a heat-generating member and a low-melting metal member on a substrate, in which the low-melting metal member is blown out by the heat generated by the heat-generating member, wherein the lateral cross section of at least part of the low-melting metal member is substantially divided into at least two independent cross sections between a pair of electrodes that pass current to the low-melting metal member.

The phrase "lateral cross section of the low-melting metal member" here refers to a cross section of the low-melting metal member that is perpendicular to the direction of current flowing through said low-melting metal member.

Also, saying that the lateral cross section of the low-melting metal member is substantially divided into at least two independent cross sections refers not only to when the lateral cross section of the low-melting metal member is divided into at least two independent cross sections before the heat-generating member starts generating heat, but also to when there is a single, contiguous cross section before the heat-generating member starts generating heat, but this is quickly divided into at least two independent cross sections by the heat generated by the heat-generating member.

BEST MODE FOR CARRYING OUT THE INVENTION

Figure 1A:
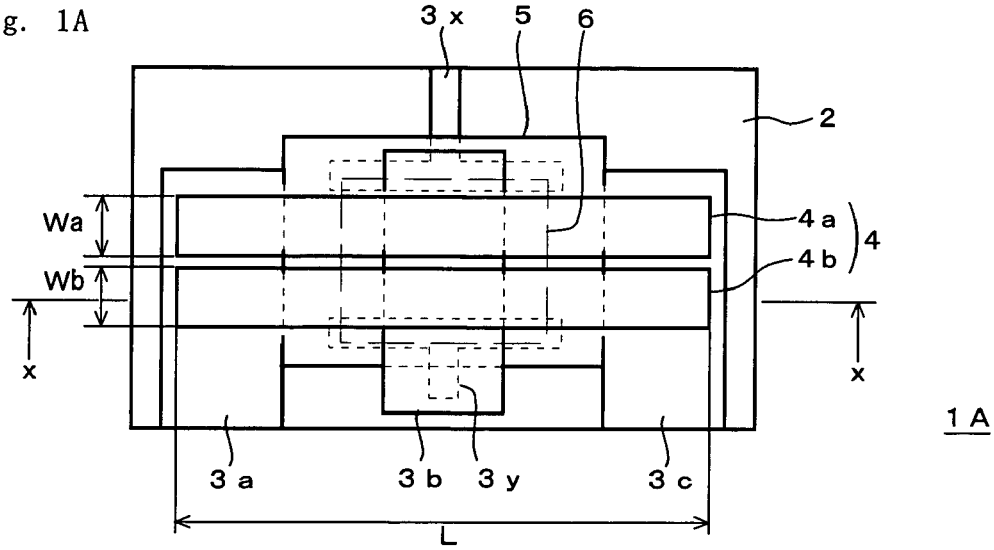
FIG. 1A is a plan view of the protective element of the present invention.

The present invention will now be described in detail through reference to the drawings. Similar or identical constituent elements in the drawings are all numbered the same.

Figure 1B:
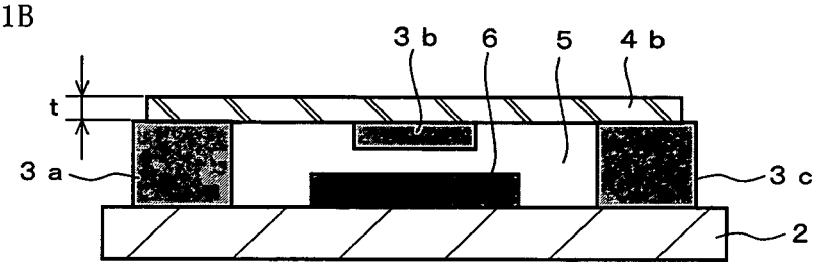
FIG. 1B is a cross section thereof.

FIG. 1A is a plan view of the protective element 1A in one aspect of the present invention, and FIG. 1B is a cross section thereof. This protective element 1A has a structure in which a heat-generating member 6, an insulating layer 5, and a low-melting metal member 4 are layered in that order on a substrate 2. Here, the low-melting metal member 4 is made up of two strips, namely, a first flat low-melting metal member 4*a* with a width Wa, a thickness t, and a length L, and a second flat low-melting metal member 4*b* with a width Wb (the same as that of the flat low-melting metal member 4*a*), a thickness t, and a length L, and is connected at its ends to electrodes 3*a* and 3*c* and at its middle to an electrode 3*b*.

Figure 2:
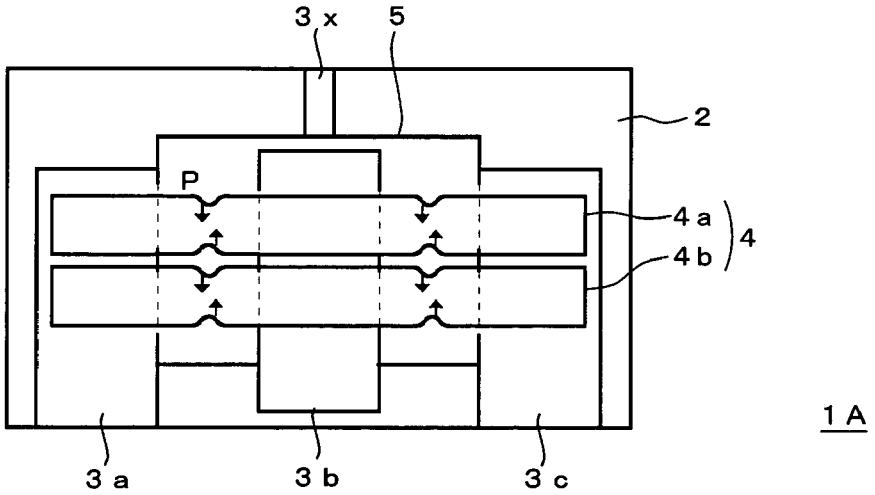
FIG. 2 is a plan view of when the protective element of the present invention is beginning to be blown out.

If the two strips comprising the flat low-melting metal members 4*a* and 4*b* are thus laid out horizontally as the low-melting metal member 4, when the heat-generating member 6 generates heat, the two flat low-melting metal members 4*a* and 4*b* melt, and first, as shown in FIG. 2, blow-out commencement points P form in the middle portions and on both sides of the flat low-melting metal members 4*a* and 4*b* between the electrode 3*a* and the electrode 3*b* and between the electrode 3*b* and the electrode 3*c* (a total of eight sites), and the flat low-melting metal members 4*a* and 4*b* begin to constrict from these blow-out commencement points P as indicated by the arrows. Then, surface tension causes the low-melting metal members to attempt to form spheres over the electrodes 3*a*, 3*b*, and 3*c*, and the constriction at the blow-out commencement points P increases until blow-out occurs at four sites.

Figure 15:
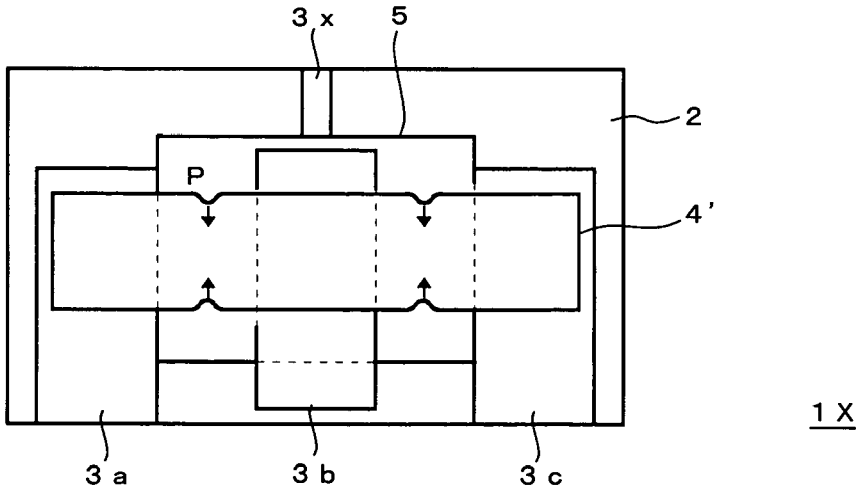
FIG. 15 is a plan view of when a conventional protective element is beginning to be blown out.

In contrast, if, as shown by the protective element 1X in FIG. 15, as a low-melting metal member, a single strip of low-melting metal member 4', whose thickness t and length L are the same as those of the above-mentioned flat low-melting metal members 4*a* and 4*b* and whose width W is equal to the sum of the widths Wa and Wb of the flat low-melting metal members 4*a* and 4*b* (that is, the sectional area of a lateral cross section is equal to the sum of the sectional area of lateral cross sections of the flat low-melting metal members 4*a* and 4*b*, and the rated current (fuse resistance) is the same as that of the protective element 1A in FIG. 1A), is disposed, then the heat generated by the heat-generating member 6 will cause this low-melting metal member 4' to begin constricting and be blown-out from the four blow-out commencement points P, as indicated by the arrows in FIG. 15.

Therefore, if the lateral cross section of the low-melting metal member 4 is divided into two areas consisting of the lateral cross section of the first flat low-melting metal member 4*a* and the lateral cross section of the second flat low-melting metal member 4*b*, as is the case with the protective element 1A shown in FIG. 1A, the number of the blow-out commencement points P will increase and the molten low-melting metal member 4 will flow more readily over the electrodes 3*a*, 3*b*, and 3*c*, which shortens the operating time.

Furthermore, the time it takes for blow-out of the low-melting metal member fluctuates with the surface condition of the insulating layer 5 underlying the low-melting metal member 4 and other such factors, but if, as with the protective element 1A shown in FIG. 1A, two stripes of the flat low-melting metal members 4*a* and 4*b* are provided between a pair of electrodes (between the electrode 3*a* and the electrode 3*b*, or between the electrode 3*b* and the electrode 3*c*), then when one of two strips of the flat low-melting metal members is blown out between a pair of electrodes, twice the amount of current as before this first flat low-melting metal member blew out will flow to the remaining flat low-melting metal member, so the remaining flat low-melting metal member will also blow out quickly. The result is a reduction in the variance of the operating time of the protective element 1A.

Also, the low-melting metal member 4 that comes together on the electrode 3*a*, 3*b*, or 3*c* after blow-out is thinner with the protective element 1A in FIG. 1A than with the protective element 1X in FIG. 15. Therefore, the protective element 1A in FIG. 1A, in which there are two strips of the low-melting metal members between the pair of electrodes, allows the thickness of the element to be reduced.

Figure 3A:
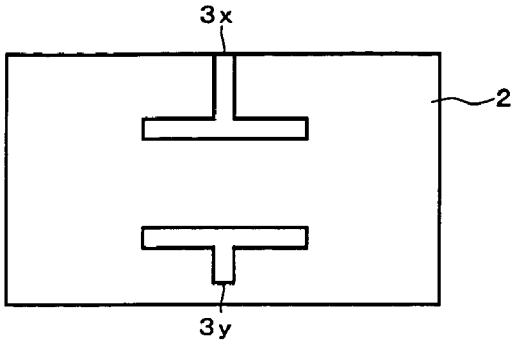
FIGS. 3A to 3E are diagrams of the steps involved in manufacturing the protective element of the present invention.
Figure 3B:
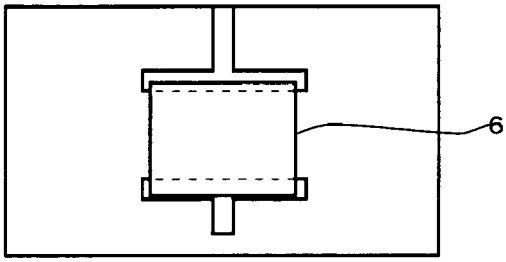
Figure 3C:
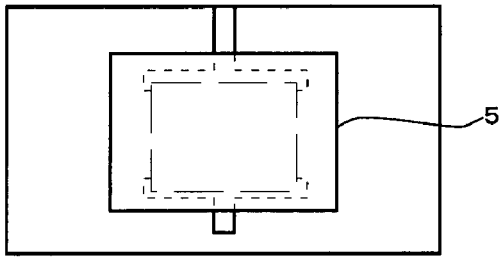
Figure 3D:
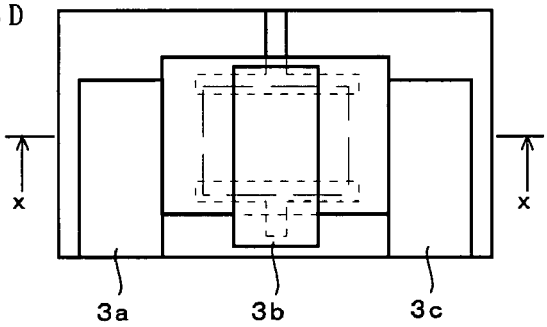
Figure 3D:
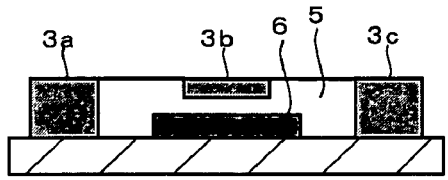
Figure 3E:
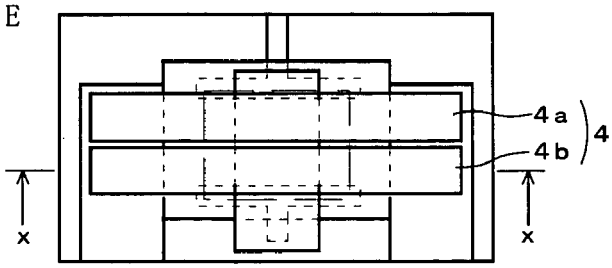
Figure 3E:
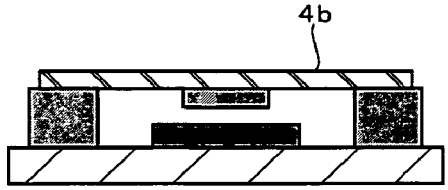

The protective element 1A in FIG. 1A can be manufactured as shown in FIGS. 3A to 3E, for example. First, electrodes (so-called cushion electrodes) 3*x* and 3*y* for the heat-generating member 6 are formed on the substrate 2 (FIG. 3A), and then the heat-generating member 6 is formed (FIG. 3B). This heat-generating member 6 is formed, for example, by printing and baking a ruthenium oxide-based paste. Next, if needed, the heat-generating member 6 is trimmed with an excimer laser or the like in order to adjust the resistance of the heat-generating member 6, after which the insulating layer 5 is formed so as to cover the heat-generating member 6 (FIG. 3C). Next, the electrodes 3*a*, 3*b*, 3*c* for the low-melting metal members are formed (FIG. 3D). The two strips of the flat low-melting metal members 4*a* and 4*b* are then provided so as to bridge these electrodes 3*a*, 3*b*, and 3*c* (FIG. 3E).

The forming materials of the substrate 2, the electrodes 3*a*, 3*b*, 3*c*, 3*x*, and 3*y*, the heat-generating member 6, the insulating layer 5, and the low-melting metal member 4, and the methods for forming these, can be the same as in prior art. Therefore, for example, the substrate 2 can be formed of a plastic film, glass epoxy substrate, ceramic substrate, metal substrate or the like, and is preferably an inorganic substrate.

The heat-generating member 6 can be formed, for example, by coating the substrate with a resistor paste composed of a conductive material such as ruthenium oxide or carbon black, and an inorganic binder (such as water glass) or an organic binder (such as a thermosetting resin), and baking this coating as needed. The heat-generating member 6 may also be formed by printing, plating, vapor depositing, sputtering, or otherwise providing a thin film such as ruthenium oxide or carbon black, or by sticking on a film of these materials, laminating them, etc.

Any of the various low-melting metal members used in the past as fuse materials can be used as the material for forming the low-melting metal member 4. For example, the alloys listed in Table 1 in paragraph [0019] of Japanese Patent Application Laid-Open No. H8-161990 can be used.

The low-melting metal member electrodes 3*a*, 3*b*, and 3*c* can be made of copper or another such metal alone, or can be plated on their surface with Ag—Pt, gold, or the like.

Figure 4:
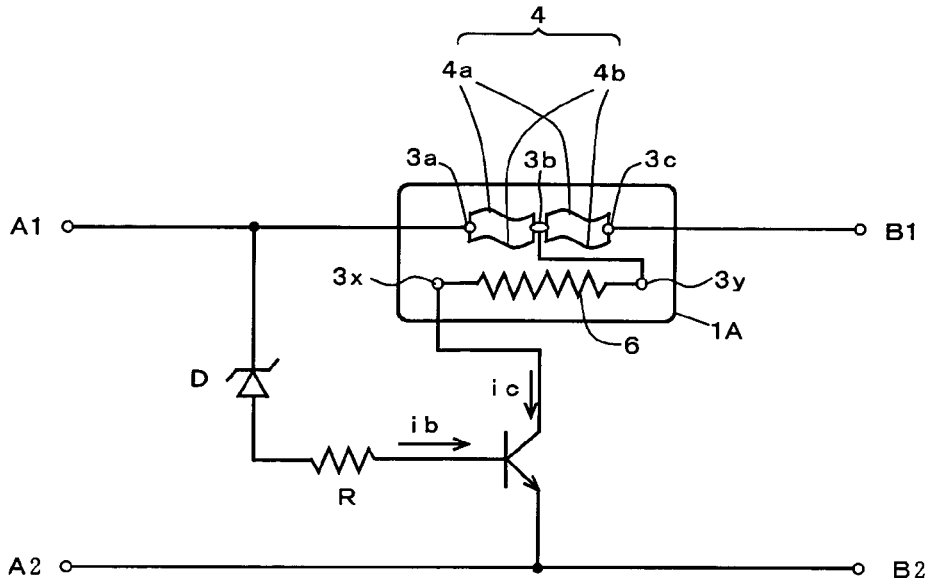
FIG. 4 is a circuit diagram of an overvoltage prevention apparatus in which the protective element of the present invention is used.

As shown in FIG. 4, an overvoltage prevention apparatus is an example of how the protective element 1A in FIG. 1A can be used. In the overvoltage prevention apparatus of FIG. 4, the electrode terminals of the device such as a lithium ion cell to be protected, are connected to terminals A1 and A2, and the electrode terminals of the charger or other such device that is connected to the device to be protected are connected to terminals B1 and B2. With this overvoltage prevention apparatus, if reverse voltage over the breakdown voltage is applied to a Zener diode D as the charging of the lithium ion cell proceeds, a base current ib flows suddenly, which causes a large collector current ic to flow to the heat-generating member 6, and the heat-generating member 6 generates heat. This heat is transmitted to the low-melting metal member 4 over the heat-generating member 6, the low-melting metal member 4 is blown out, and overvoltage is prevented from being applied to the terminals A1 and A2. In this case, the low-melting metal member 4 is blown out between the electrode 3*a* and the electrode 3*b*, and between the electrode 3*b* and the electrode 3*c*, so the flow of power to the heat-generating member 6 is completely cut off after the blow-out.

Figure 5:
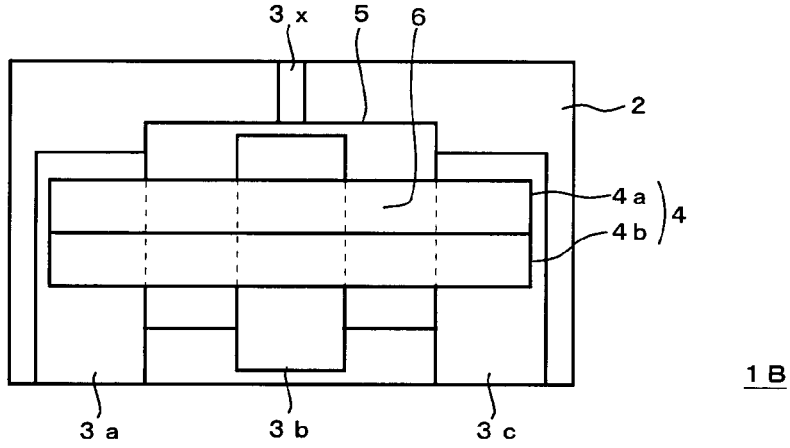
FIG. 5 is a plan view of the protective element of the present invention.
Figure 6:
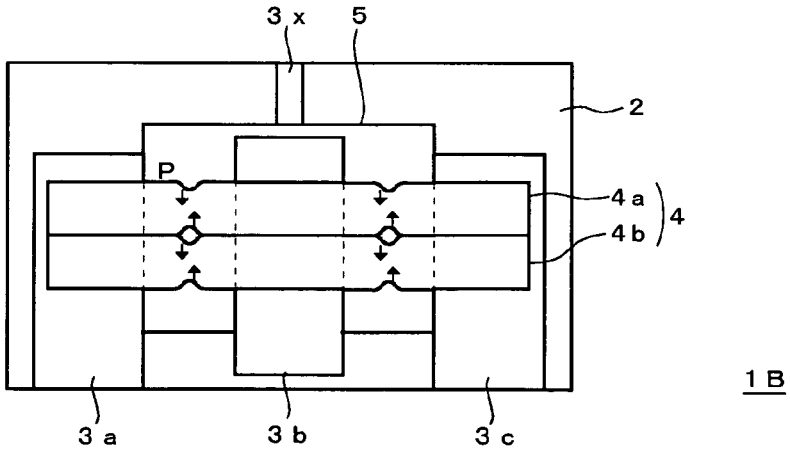
FIG. 6 is a plan view of when the protective element of the present invention is beginning to be blown out.

The protective element of the present invention can also assume various other aspects. In terms of the operating characteristics of the protective element, a wide gap is preferred between two strips of the low-melting metal members 4*a* and 4*b*, but two strips of the flat low-melting metal members 4*a* and 4*b* may also be disposed in contact with each other, as with the protective element 1B shown in FIG. 5. Even when two trips of the flat low-melting metal members 4*a* and 4*b* are thus in contact, blow-out will begin from the eight blow-out commencement points P as shown in FIG. 6 when the heat-generating member 6 generates heat, so the operating time is shortened, there is less variance in the operating time, and a thinner element can be obtained.

Figure 7:
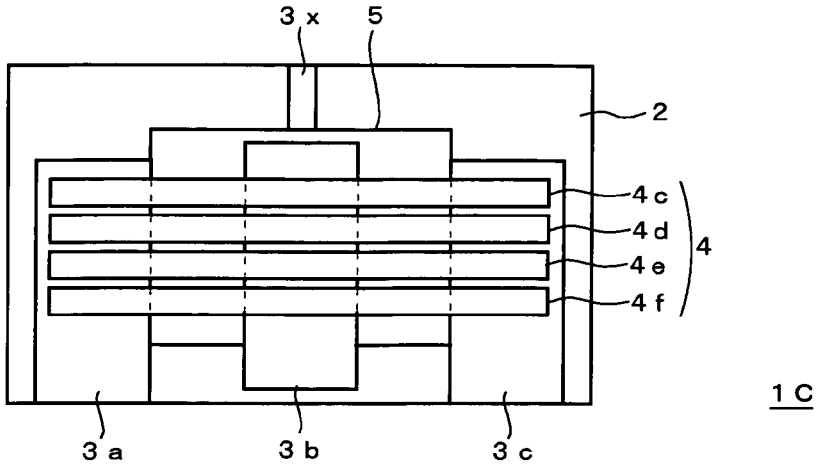
FIG. 7 is a plan view of the protective element of the present invention.

With the protective element 1C in FIG. 7, four strips of the flat low-melting metal members 4*c*, 4*d*, 4*e*, and 4*f* are provided instead of two strips of the flat low-melting metal members 4*a* and 4*b* in FIG. 1A, such that the total lateral cross sectional area thereof is equal to the total lateral cross sectional area of the two flat low-melting metal members 4*a* and 4*b* in FIG. 1A.

Thus increasing the number of divisions of the lateral cross section of the low-melting metal member 4 better suppresses variance in the operating time and shortens the operating time even more. There are no particular restrictions on the number of divisions of the lateral cross section of the low-melting metal member in the present invention.

Figure 8:
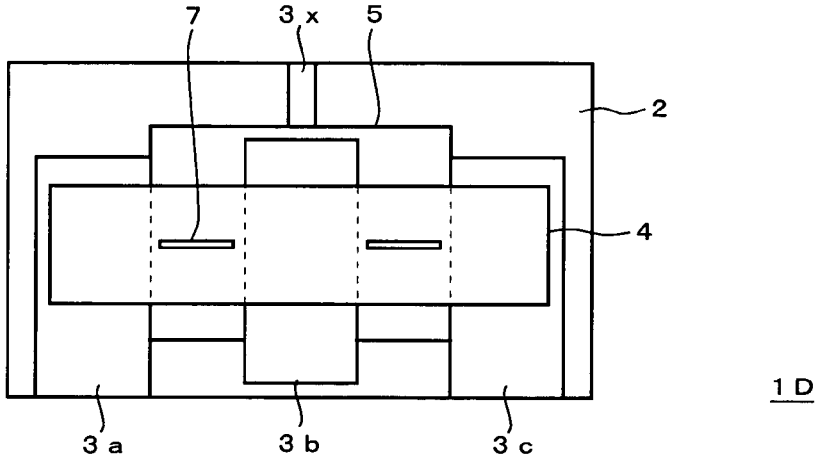
FIG. 8 is a plan view of the protective element of the present invention.

With the protective element 1D in FIG. 8, a slit 7 extending in the direction of current flow is provided to the low-melting metal member 4 between the electrode 3*a* and the electrode 3*b*, and between the electrode 3*b* and the electrode 3*c*, so as to form regions where the lateral cross section is divided in two between these electrodes.

Figure 9:
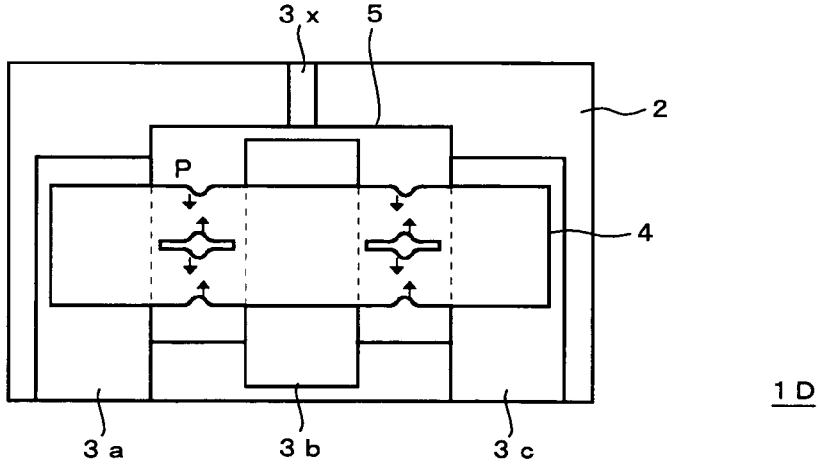
FIG. 9 is a plan view of when the protective element of the present invention is beginning to be blown out.

The result of forming this slit 7 is that the low-melting metal member 4 begins to be constricted from the eight blow-out commencement points P when the heat-generating member 6 start generating heat as indicated by the arrows in FIG. 9, so the operating time is shortened, there is less variance in the operating time, and a thinner element can be obtained.

There are no particular restrictions on the number of divisions when the lateral cross section of the low-melting metal member is divided into independent regions by slits.

Figure 10A:
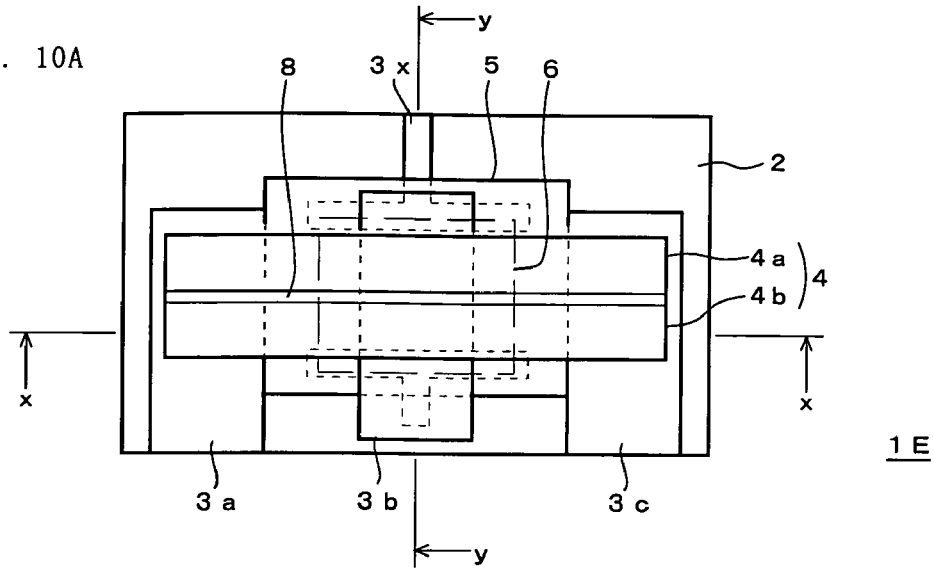
FIG. 10A is a plan view of the protective element of the present invention.
Figure 10B:
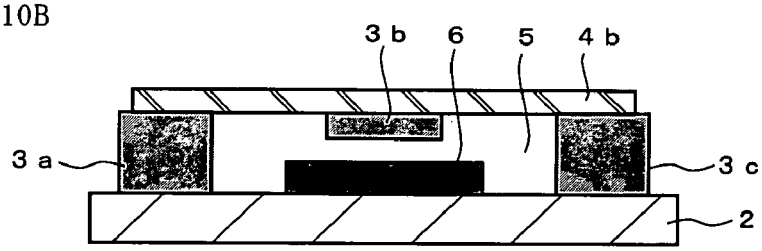
FIGS. 10B and 10C are cross sectional views thereof.
Figure 10C:
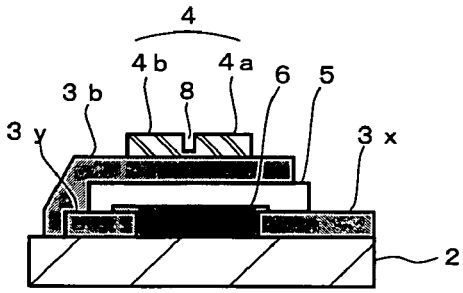
Figure 11:
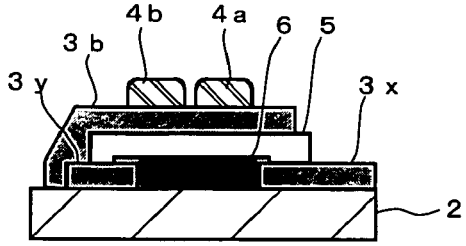
FIG. 11 is a cross sectional views of when the protective element of the present invention is beginning to be blown out.

With the protective element 1E in FIG. 10A, before the heat-generating member 6 starts generating heat, the lateral cross section of the low-melting metal member 4 consists of a single, contiguous region, but a groove 8 extending in the direction of current flow is provided in the center of the low-melting metal member 4, so that the low-melting metal member 4 is thinner at this portion, and when the heat-generating member 6 starts generating heat, this quickly divides into two independent cross sections as shown in FIG. 11. After this division into two independent cross sections, the operation is the same as with the protective element in FIG. 1A.

Figure 12A:
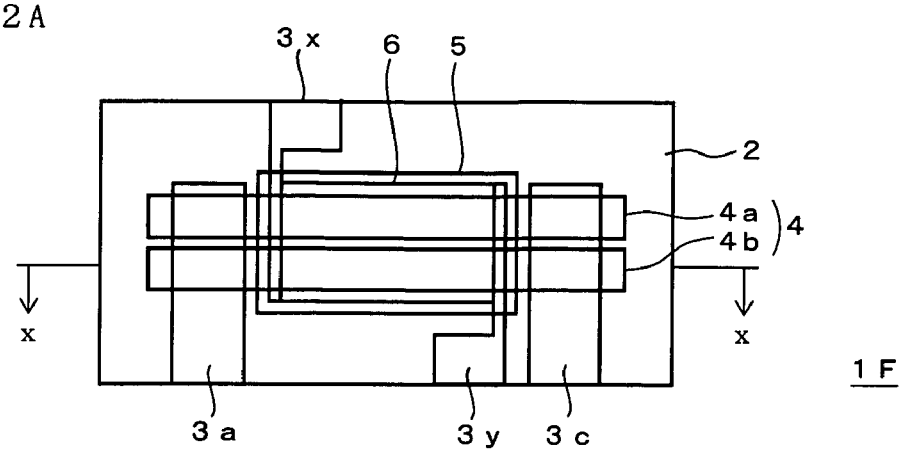
FIG. 12A is a plan view of the protective element of the present invention.
Figure 12B:
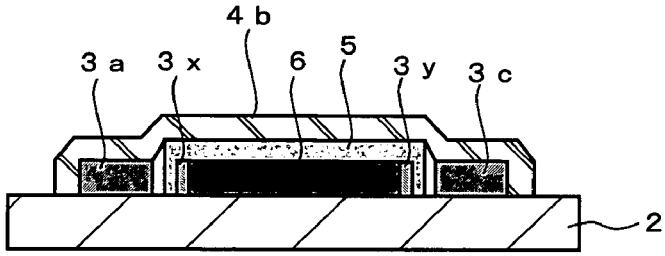
FIG. 12B is a cross sectional view thereof.
Figure 13:
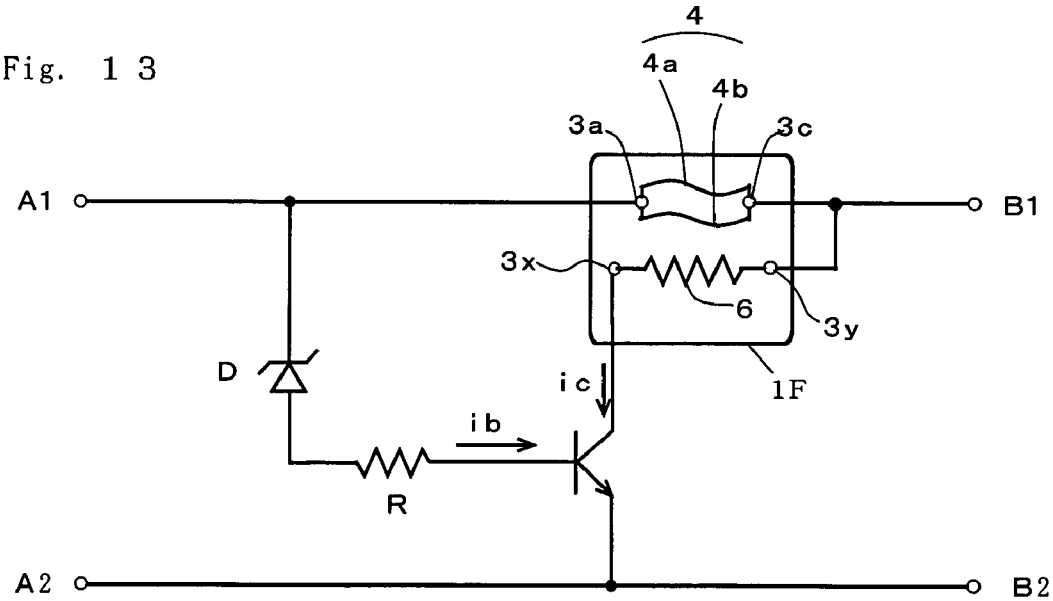
FIG. 13 is a circuit diagram of an overvoltage prevention apparatus in which the protective element of the present invention is used.

The protective element of the present invention is not limited to a configuration in which the low-melting metal member is blown out between two pairs of electrodes (the electrode 3*a* and the electrode 3*b*, and the electrode 3*b* and the electrode 3*b*), and may instead be constituted so that the low-melting metal member is blown out between just one pair of electrodes, as dictated by the application. For instance, a protective element used in the overvoltage prevention apparatus of the circuit diagram shown in FIG. 13 may have a constitution that omits the electrode 3*b*, as with the protective element 1F shown in FIG. 12A. Again with this protective element 1F, two flat low-melting metal members 4*a* and 4*b* are provided between the pair of electrodes 3*a* and 3*c*.

Further, the shape of the individual low-melting metal members 4 in the protective element of the present invention is not limited to a flat shape, and may instead be in the form of a round rod, for example. Also, the low-melting metal member 4 is not limited to being layered over the heat-generating member 6 via the insulating layer 5, and the low-melting metal member and the heat-generating member may instead be disposed in the same plane, and the low-melting metal member blown out by the heat from the heat-generating member.

Also, with the protective element of the present invention, the top of the low-melting metal member can be capped with 4,6-nylon, a liquid crystal polymer, or the like.

EXAMPLES

The present invention will now be described in specific terms through examples.

Example 1

The protective element 1A in FIG. 1A was produced as follows. An alumina-based ceramic substrate (0.5 mm thick and measuring 5 mm×3 mm) was readied as the substrate 2, on which was printed a silver-palladium paste (6177T made by DuPont), and this coating was baked (0.5 hour at 850° C.) to form electrodes 3*x* and 3*y* for the heat-generating member 6.

Next, this was printed with a ruthenium oxide-based paste (DP1900 made by DuPont), and this coating was baked (0.5 hour at 850° C.) to form the heat-generating member 6.

After this, the insulating layer 5 was formed over the heat-generating member 6 by printing an insulating glass paste. The low-melting metal member electrodes 3*a*, 3*b*, and 3*c* were then formed by printing a silver-platinum paste (5164N made by DuPont) and baking (0.5 hour at 850° C.). Two pieces of solder foil (Sn:Sb=95:5, liquid phase point: 240° C., width W=0.5 mm, thickness t=0.1 mm, length L=4.0 mm) were connected as the low-melting metal member 4 so as to bridge the electrodes 3*a*, 3*b*, and 3*c*, which yielded the protective element 1A.

Example 2

The protective element 1C (FIG. 7) was produced in the same manner as in Example 1, except that four pieces of solder foil with a width W of 0.25 mm were used as the low-melting metal member 4 instead of the two pieces of solder foil with a width W of 0.5 mm.

Comparative Example 1

Figure 14A:
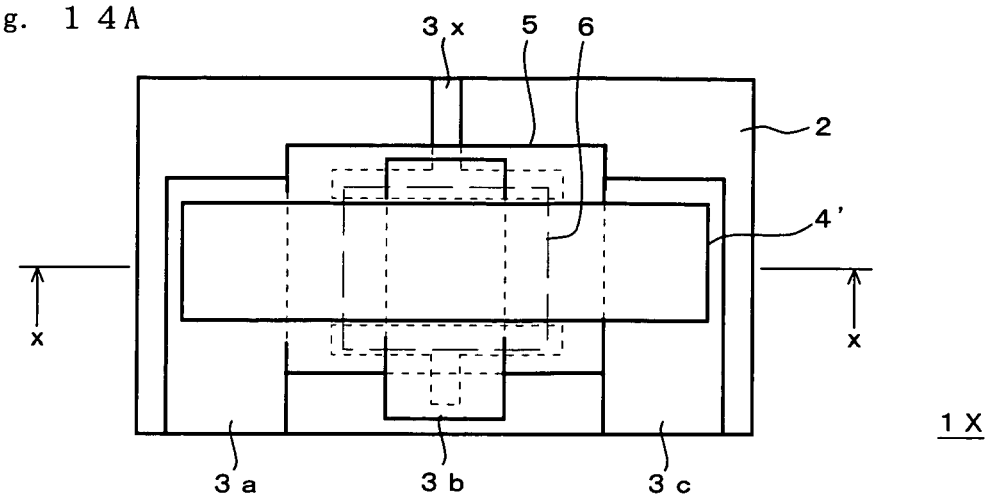
FIG. 14A is a plan view of a conventional protective element.
Figure 14B:
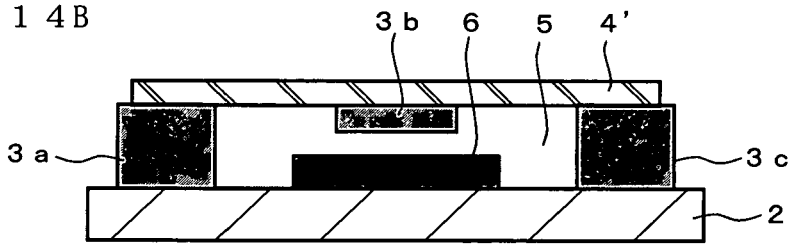
FIG. 14B is a cross sectional view thereof.

The protective element 1X (FIG. 14) was produced in the same manner as in Example 1, except that one piece of solder foil with a width W of 1 mm was used as the low-melting metal member 4 instead of the two pieces of solder foil with a width W of 0.5 mm.

Example 3

The protective element 1A was produced in the same manner as in Example 1, except that the thickness t of the low-melting metal member was changed to 0.3 mm.

Example 4

The protective element 1A was produced in the same manner as in Example 2, except that the thickness t of the low-melting metal member was changed to 0.3 mm.

Comparative Example 2

The protective element 1X was produced in the same manner as in Comparative Example 1, except that the thickness t of the low-melting metal member was changed to 0.3 mm.

Evaluation

Power of 4 W was applied to the heat-generating member of the protective element in each of Examples 1 to 4 and Comparative Examples 1 and 2, and the time was measured from the application of power until the blow-out of the low-melting metal member (fuse blow-out time).

Also, for the protective elements of Examples 3 and 4 and Comparative Example 2, a current of 12 A was passed through the low-melting metal member, and the time it took for the low-melting metal member to blow out was measured. These results are given in Table 1.

TABLE 1

| | Low-melting metal member | | | | | Blow-out time (seconds) | |
|---|---|---|---|---|---|---|---|
| | Size (units: mm) | | | | | Heat-generating member | Low-melting metal member |
| | Width W | Thickness t | Length L | Resistance (mΩ) | Number | When 4 W applied | With 12 A current |
| Ex. 1 | 0.5 | 0.1 | 4.0 | 10 ± 1 | 2 | 12-16 | |
| Ex. 2 | 0.25 | 0.1 | 4.0 | 10 ± 1 | 4 | 10-13 | |
| C.E. 1 | 1.0 | 0.1 | 4.0 | 10 ± 1 | 1 | 15-25 | |
| Ex. 3 | 0.5 | 0.3 | 4.0 | 5 ± 1 | 2 | 20-30 | 9-12 |
| Ex. 4 | 0.25 | 0.3 | 4.0 | 5 ± 1 | 4 | 15-18 | 8-11 |
| C.E. 2 | 1.0 | 0.3 | 4.0 | 5 ± 1 | 1 | did not melt in 120 sec. | 10-16 |

[C.E.: Comparative Example]

It can be seen from these results that with the examples of the present invention, the operating time when the heat-generating member starts generating heat can be shortened and variance in the operating time can be suppressed without changing the rated current (fuse resistance). It can also be seen that the operating time can be shortened, and variance thereof can be suppressed, when over-current flows to the low-melting metal member.

INDUSTRIAL APPLICABILITY

With the present invention, the operating time can be shortened and made more consistent in a protective element comprising a heat-generating member and a low-melting metal member on a substrate, in which the low-melting metal member is blown out by the heat generated by the heat-generating member. Therefore, the operating time can be sufficiently shortened, and variance in the operating time can be suppressed, even when the cross sectional area of the low-melting metal member is increased in order to raise the rated current.

The invention claimed is:

1. A protective element, comprising:

a heat-generating member; and a low-melting metal member on a substrate between a pair of electrodes that pass current through the low-melting member, in which the low-melting metal member is blown out by the heat generated by the heat-generating member;

the low-melting metal member having a groove provided in the center that extends in the direction of current flow that blows out as an effect of the heat-generating member generating heat, so that the lateral cross section along the entire length of the low-melting metal member in the direction of the current flow divides into at least two independent cross sections.

* * * * *